US005857794A

United States Patent [19]

Chien

[11] Patent Number: 5,857,794

[45] Date of Patent: Jan. 12, 1999

[54] STRUCTURE OF BATHING CONTAINER

[76] Inventor: Kuo-Ching Chien, No. 7, Lane 74, Kung-Wu Road, Lung-Tan, Tao-Yuan, Taiwan

[21] Appl. No.: 32,848

[22] Filed: Mar. 2, 1998

[51] Int. Cl.[6] ..... B65D 30/06

[52] U.S. Cl. ..... 401/201; 383/117; 206/77.1

[58] Field of Search ..... 401/200, 201; 206/77.1; 383/72, 74, 109, 117

[56] References Cited

U.S. PATENT DOCUMENTS

| | | | |
|---|---|---|---|
| 684,234 | 10/1901 | Haywood | 383/117 |
| 1,445,835 | 2/1923 | Hooper | 383/117 |
| 2,607,940 | 8/1952 | Miller | 383/117 |
| 3,977,745 | 8/1976 | Wright | 401/201 |
| 4,228,834 | 10/1980 | Desnick | 383/117 |
| 4,979,833 | 12/1990 | Cook | 383/117 |
| 5,031,759 | 7/1991 | Ogilivie | 383/117 |
| 5,238,305 | 8/1993 | Feller | 383/117 |

*Primary Examiner*—Charles R. Eloshway
*Attorney, Agent, or Firm*—Bacon & Thomas

[57] ABSTRACT

An improved bathing soap container has two pouches spaced for the allocation of soap, a sponge or rubbing balls. The container is constructed by folding both ends of a hollow cylindrical mesh to form two cuffs which overlap, tying the overlap region with a cord to form a longer first pouch portion and a shorter second pouch portion, folding part of the second pouch portion over the bottom of the first pouch portion to form an inner space between the two pouches, folding the mouth of the first pouch portion over the top of the second pouch portion, and tying the mouth of the first pouch portion with a cord having an apertured tightening bead. The inner space is arranged to hold a sponge or rubbing balls while the mouth of the first pouch portion may be folded over to accommodate a smaller sized soap.

3 Claims, 6 Drawing Sheets

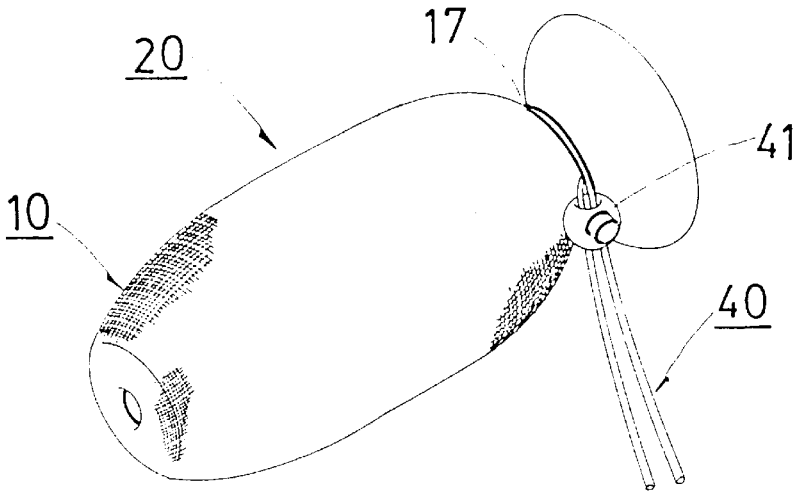
Fig. 3
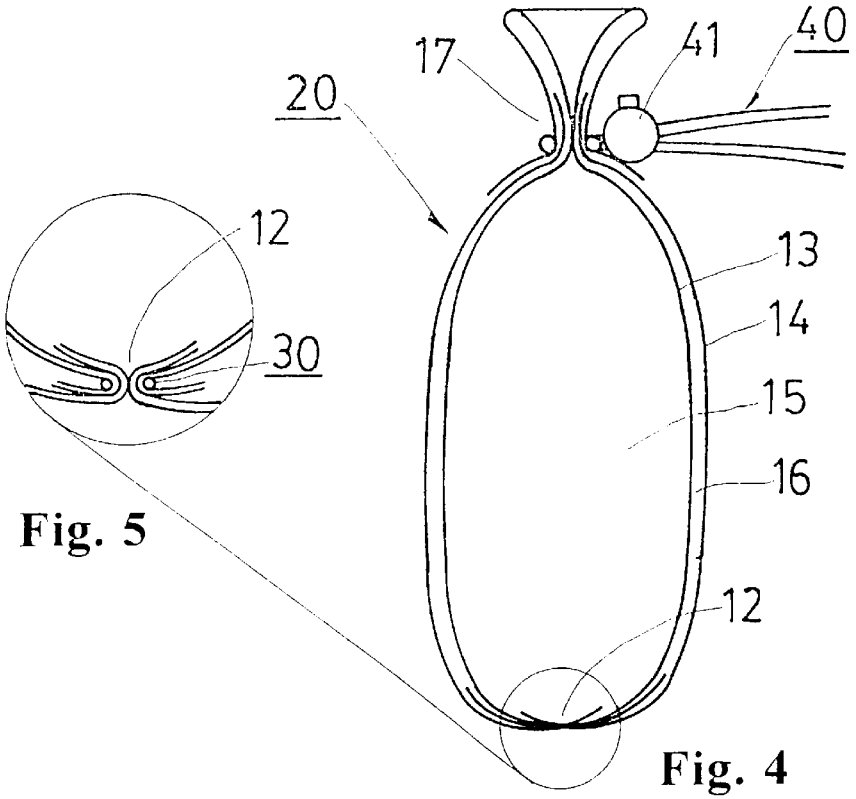
Fig. 5
Fig. 4

STRUCTURE OF BATHING CONTAINER

FIELD OF THE PRESENT UTILITY

The present utility relates to a bathing means, more particularly, to an improved structure of bathing means which has two pouches spaced for the allocation of soap, sponge, a rubbing ball etc. such that the bathing means can achieve cleaning and rubbing during bath of user and can shrink its pouched space when the volume of soap decreases.

BACKGROUND OF THE PRESENT UTILITY

The objects of a bath are to clean the body and give a fresh and comfortable feeling. In general the bather applies the soap to the body portion to be cleaned and then it is rinsed by water, or the bather pours bathing shampoo on his palm and kneads the shampoo to the body portion to be cleaned, then rinses with water. However, only a limited portion of body can be cleaned by the above bathing because the soap and the shampoo can not be applied uniformly and thoroughly over the bather's body merely by hands.

Moreover, some auxiliary means, such as a bathing brush or bathing ball, are developed to apply soap or shampoo to the bather's body. Nevertheless, the conventional bathing brush or bathing ball needs to be frequently supplied with soap or shampoo. This is troublesome and makes the use of a bathing brush or bathing ball no so popular.

FIGS. 1 and 2 show the cross-sectional view of a conventional bathing means. The bathing means is constructed by tying one open end 16 of a cylindrical mesh 1 with a clip 2 to form a pouch with a hollow space 17 and a fringe 13 on the bottom side thereof. Afterward, the pouch 1 is turned over such that the fringe 13 extends on the inner bottom surface. The hollow space 17 can accommodate soap, sponge etc. Moreover, the upper opening, of the pouch 1 is tied by a cord 3 to prevent the object placed within the hollow space 17 from dropping out.

However, the above-mentioned bathing means has below drawbacks:

1. The bottom opening 16 is tied by a clip 2 and a fringe 13 is formed with a length long enough to prevent the clip 2 from detaching from the pouch 1. The fringe 13 often forms a sharp edge which is dangerous for users if extends out of the pouch 1.
2. The fringe 13 extends into the hollow space 17 of the pouch 1, and forms a site where dirt or suds accumulate.
3. The mesh of the pouch 1 has a predetermined size, accordingly the hollow space 17 has a definite volume. The soap placed within the hollow space 17 will be hard to handle if the size of the soap reduces after several uses.
4. The fringe 13 extends into the hollow space 17 of the pouch 1 and often forms a sharp edge which is dangerous for users if the user stretches his hand into the hollow space 17.
5. The function of above-mentioned bathing means is limited by its construction. For example, if a sponge is placed within the hollow space 17, there is no place for arranging a soap. The users need to apply soap on the pouch mesh 1 frequently.

It is an object of the present invention to provide a bathing means which can minimize the length of the fringe on the cuff portion.

It is another object of the present invention to provide a bathing means which has two pouches for the placement of soap, sponge, a rubbing ball, etc.

It is another object of the present invention to provide a bathing means, the inner space of which can be adjusted according to the variation of the object placed therein.

BRIEF DESCRIPTION OF THE DRAWINGS

In order that the present invention may more readily be understood the following description is given, merely by way of example with reference to the accompanying drawings, in which:

FIG. 3 is a perspective view of the bathing means according to the present invention;

FIG. 4 is a cross-sectional view of the bathing means according to the present invention;

FIG. 5 is an magnified view taken from part of bathing means in FIG. 4.

DETAILED DESCRIPTION OF PREFERRED EMBODIMENT

Figure 1:
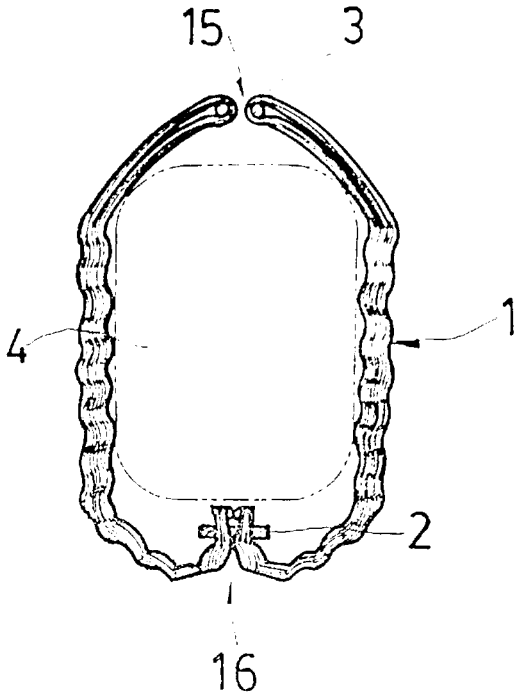
Fig. 1 PRIOR ART
FIG. 1 is the cross-sectional view of a conventional bathing means.
Figure 2:
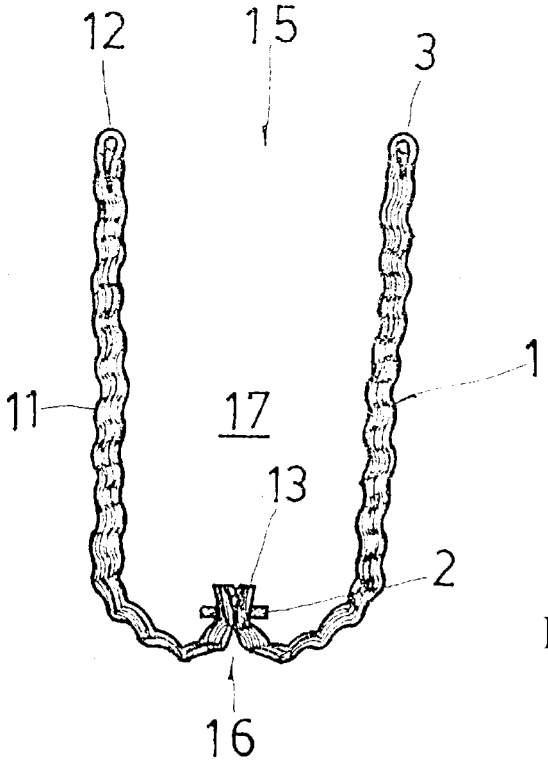
Fig. 2 PRIOR ART
FIG. 2 is another cross-sectional view of a conventional bathing means.
Figure 6:
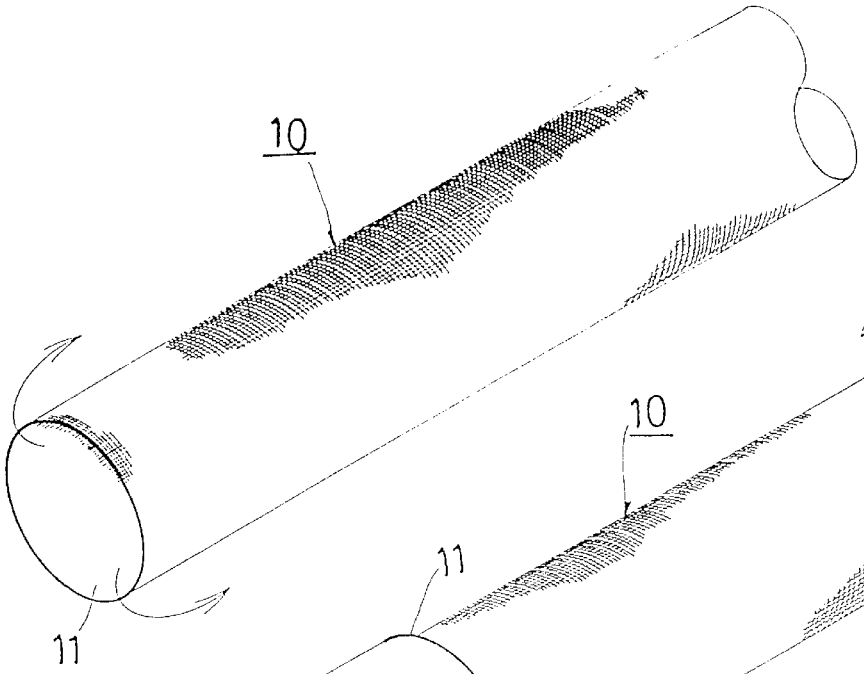
FIG. 6 is for showing the way of constructing of the bathing means according to the present invention.
Figure 7:
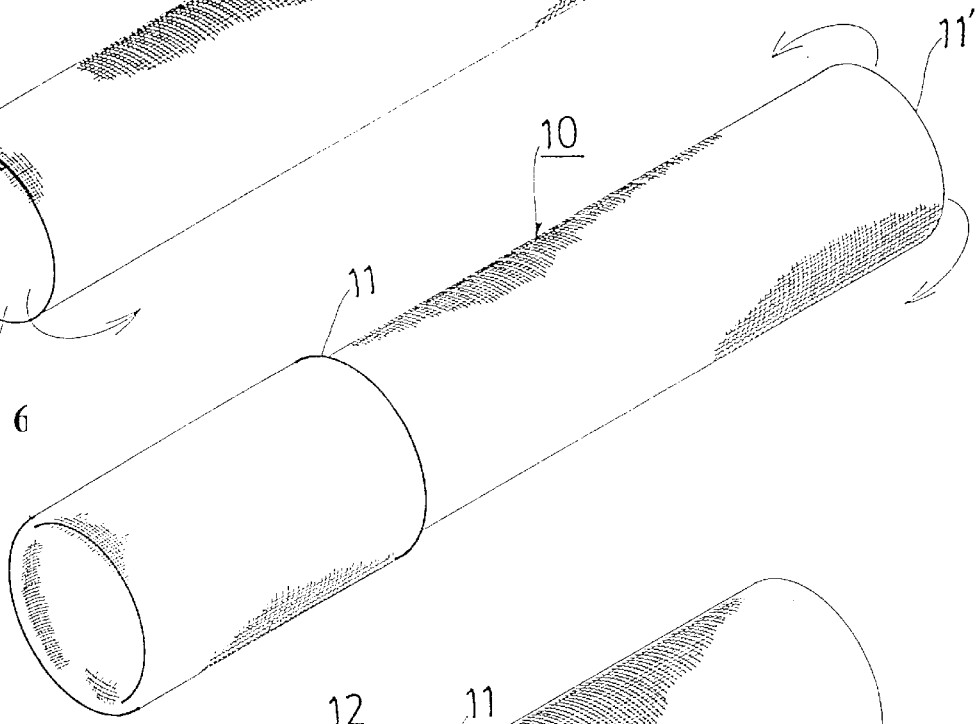
FIG. 7 is still for showing the way of constructing of the bathing means according to the present invention.
Figure 8:
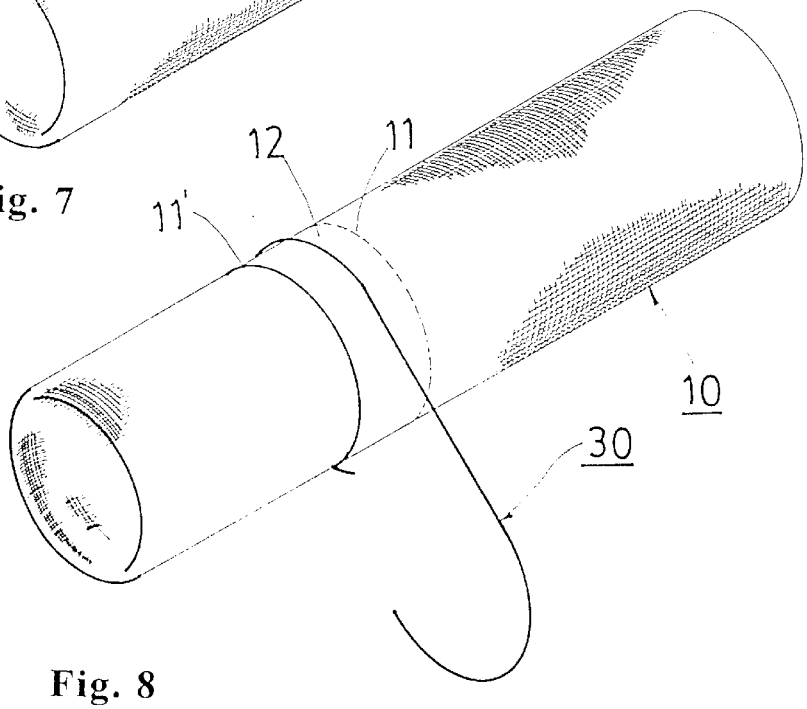
FIG. 8 is still for showing the way of constructing of the bathing means according to the present invention.
Figure 9:
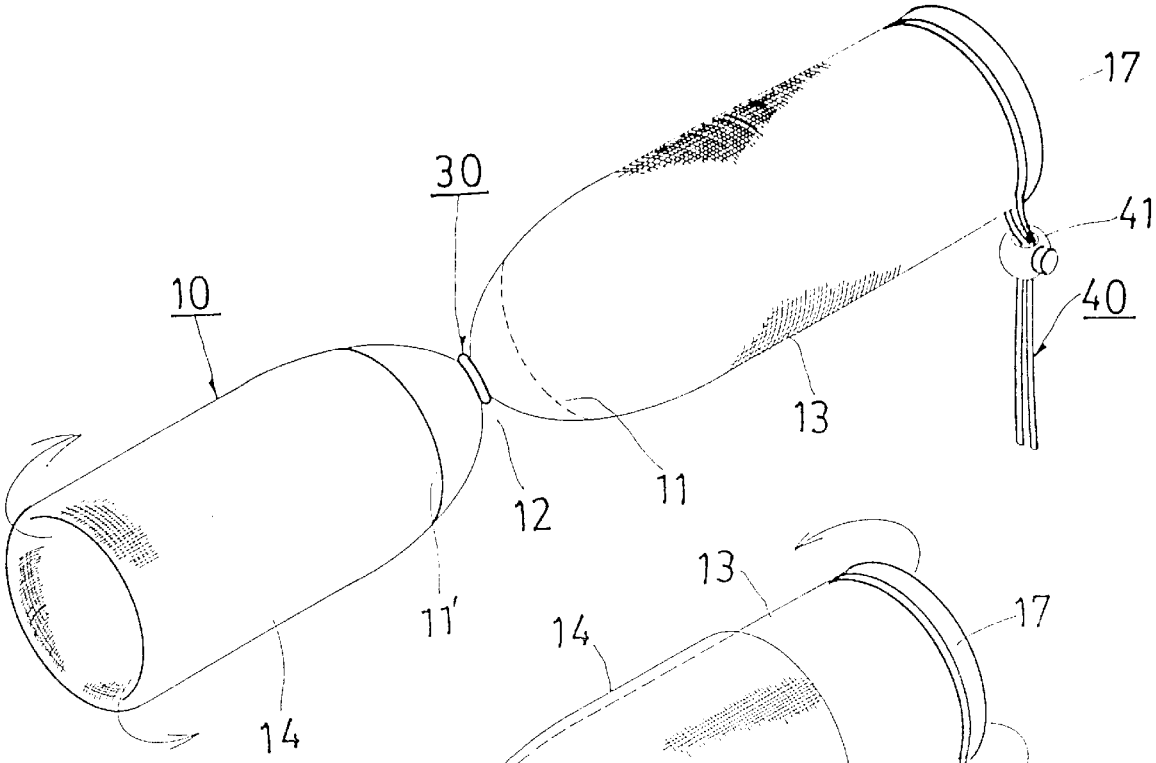
FIG. 9 is still for showing the way of constructing of the bathing means according to the present invention.
Figure 10:
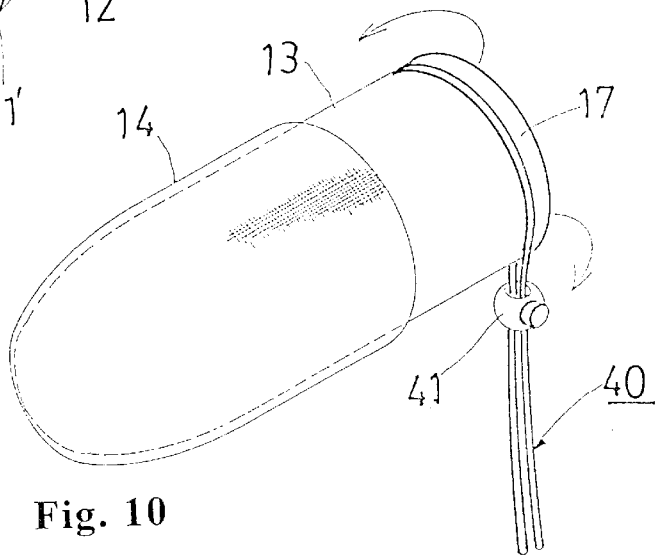
FIG. 10 is still for showing the way of constructing of the bathing means according to the present invention.
Figure 11:
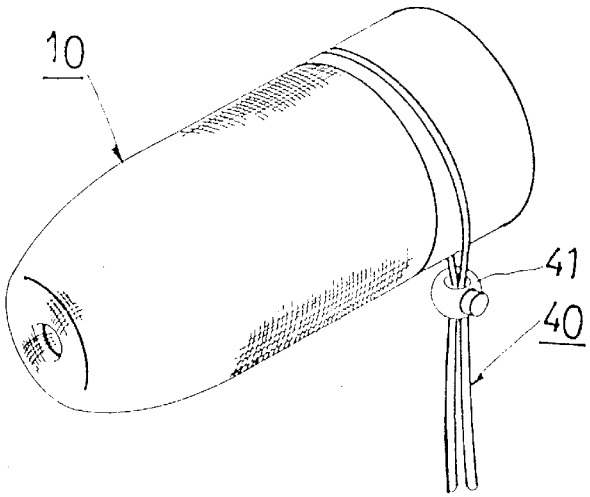
FIG. 11 is still for showing the way of constructing of the bathing means according to the present invention.

FIGS. 6–8 show the way of constructing of the bathing means according to the present invention. As shown in FIGS. 6 and 7, a cylindrical mesh 10 with two open ends is turned-up on both ends to form a first cuff 11 and a second cuff 11', wherein the first cuff 11 and the second cuff 11' have an overlap region 12. Afterward, as shown in FIG. 8, a wire 30 is tied on the overlap region 12 to form a first pouch portion 13 and a second pouch portion 14 wherein the second pouch portion 14 has a smaller length. As shown in FIGS. 9 and 10, the second pouch portion 14 is then folded to cover the first pouch portion 13, and the mouth 17 of the first pouch portion 13 is tied by a cord 40 running through an apertured bead 41, thus forming the bathing means 20 according to the present invention shown in FIG. 11

As shown in FIG. 4, the bathing means 20 according to the present invention has an inner space 15 formed within the first pouch portion 13, and an outer space 16 formed between the first pouch portion 13 and the second pouch portion 14. Moreover, the mouth 17 of the first pouch portion 13 can be tied by a cord 40 equipped with an apertured bead 41.

Figure 12:
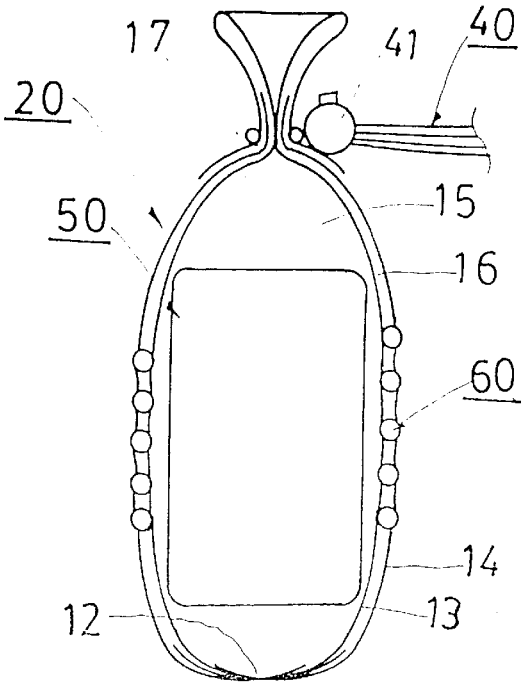
FIG. 12 shows an embodiment of the bathing means according to the present invention.
Figure 13:
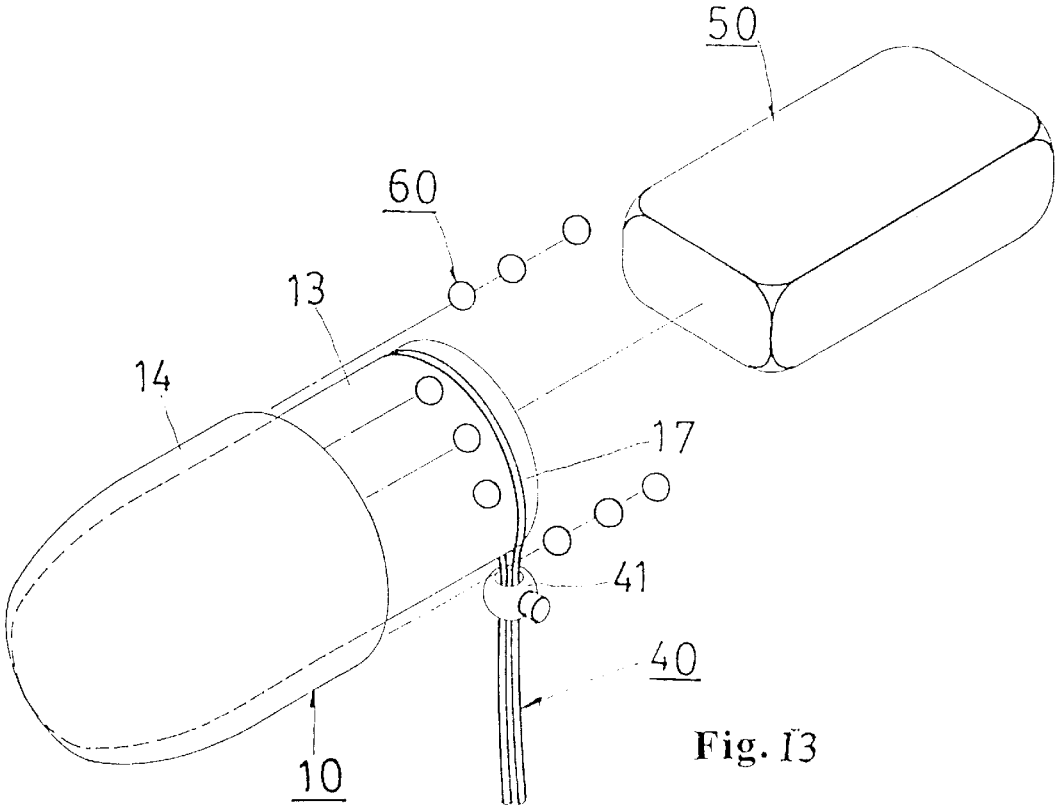
FIG. 13 shows an exploded view of the bathing means in FIG. 12.
Figure 14:
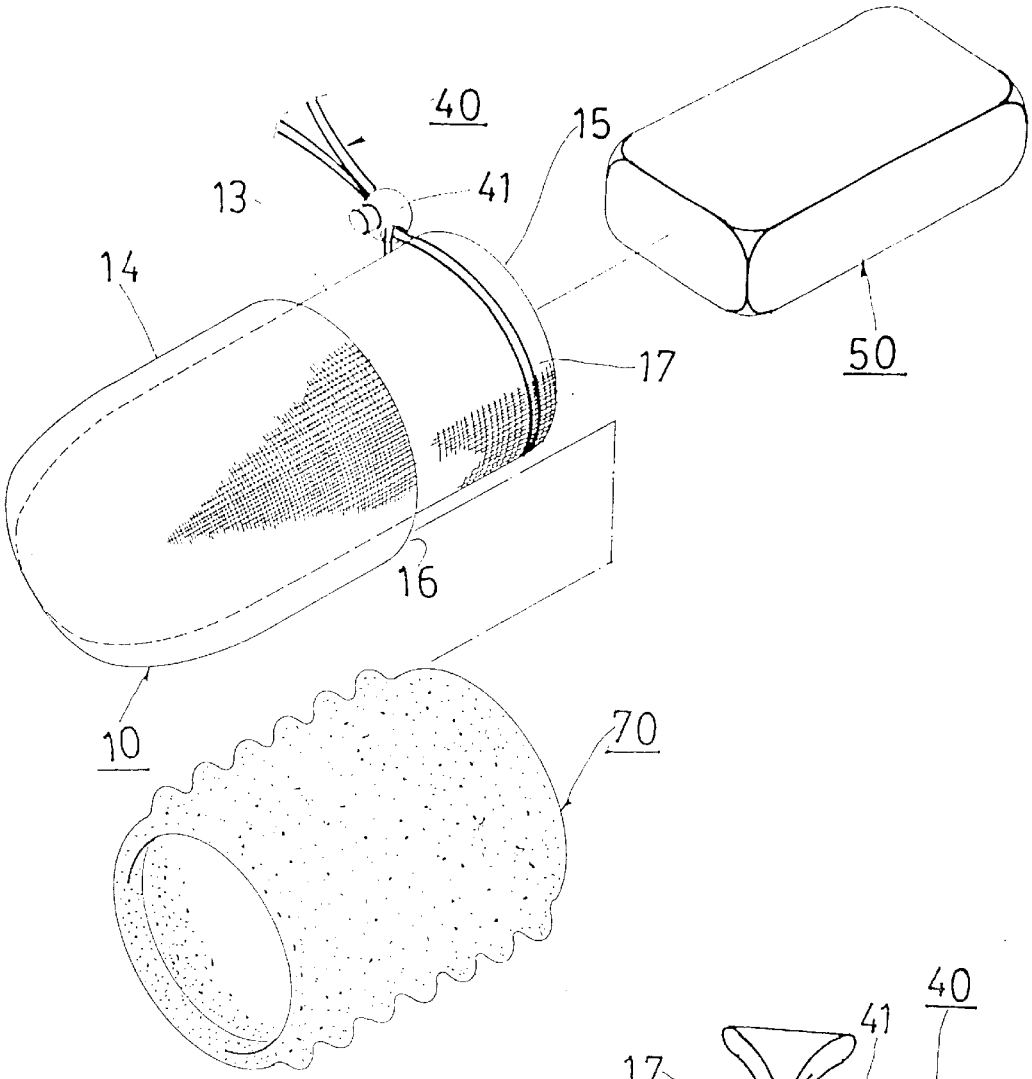
FIG. 14 shows another embodiment of the bathing means according to the present invention.
Figure 15:
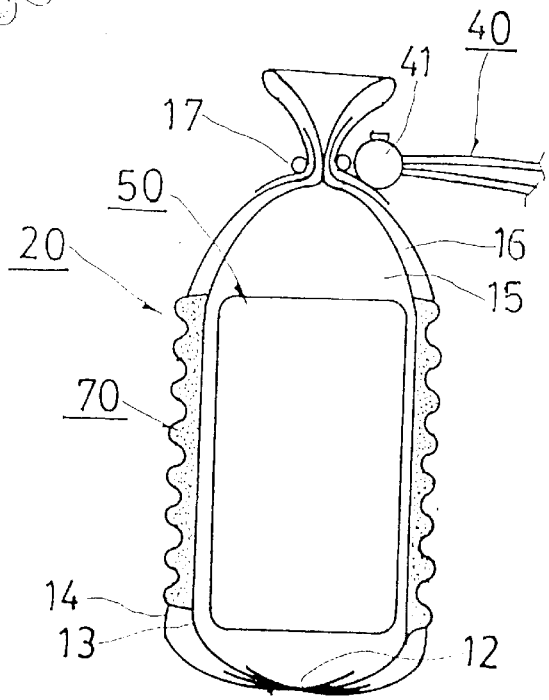
FIG. 15 shows the cross-sectional view of the bathing means in FIG. 14.

FIG. 12 shows an embodiment of the bathing means according to the present invention, and FIG. 14 shows another embodiment of the bathing means according to the present invention. As shown in FIG. 12, the mouth 17 of the first pouch portion 13 can be loosened by adjusting the bead 41, therefore a soap 50 can be placed within the inner space 15. Afterward, the mouth 17 is tightened by adjusting the bead 41 to prevent the soap 50 from dropping out (with reference to FIG. 13). Moreover, a plurality of rubbing balls 60 can be inserted into the second space 16. Therefore, the above arrangement can meet the cleaning and rubbing requirement. Alternatively, as shown in FIGS. 14 and 15, a sponge 70, in stead of rubbing ball, is inserted into the second space 16 if the user requires a better cleaning effect. Note that the mouth 17 can be folded toward the bottom side of the first pouch portion 13 if the volume of the soap 50 within the first pouch portion 13 is reduced.

To sum up, by folding both ends of a hollow cylindrical mesh in opposite directions, a bathing means with two allocating spaces is provided. The two allocating spaces of the bathing means can accommodate soap, sponge, or rubbing balls to facilitate cleaning and rubbing, and the mouth portion of the inner space can be folded further in case of a smaller soap.

While particular embodiment of the present utility has been illustrated and described, it would be obvious to those skilled in the art that various other changes and modifications can be made without departing from the spirit and scope of the invention. It is therefore intended to cover in the appended claims all such changes and modifications that are within the scope of the present utility.

I claim:

1. A bathing soap container comprising:

a hollow cylindrical mesh having opposite ends folded back onto themselves to form two cuffs, said cuffs overlapping in an overlap region;

a cord tied around said overlap region to form a longer first pouch portion and a shorter second pouch portion;

said second pouch portion having a portion which is folded over a bottom part of said first pouch portion so as to form an inner space between said first and second pouch portions, said first pouch portion also having an inner space;

an open end portion of said first pouch portion being folded over the portion of said second pouch portion which is folded over the bottom part of said first pouch portion; and a cord equipped with an apertured bead tied around a top of said first pouch portion to close said first pouch portion.

2. A bathing soap container according to claim 1, wherein said inner space between said first and second pouch portions is arranged to accommodate a sponge and a rubbing ball and said inner space in said first pouch portion is arranged to accommodate a bar of soap.

3. A bathing soap container according to claim 1, wherein the top of said first pouch portion is foldable toward the bottom of said first pouch portion to accommodate a small soap.

* * * * *